US008181814B2

(12) United States Patent
Awane et al.

(10) Patent No.: US 8,181,814 B2
(45) Date of Patent: May 22, 2012

(54) CAN CONTAINER

(75) Inventors: Hisashi Awane, Sagamihara (JP); Masami Masuda, Shizuoka (JP)

(73) Assignee: Daiwa Can Company, Tokyo (JP)

( * ) Notice: Subject to any disclaimer, the term of this patent is extended or adjusted under 35 U.S.C. 154(b) by 688 days.

(21) Appl. No.: 12/296,949

(22) PCT Filed: Apr. 21, 2006

(86) PCT No.: PCT/JP2006/308415

§ 371 (c)(1),
(2), (4) Date: Oct. 13, 2008

(87) PCT Pub. No.: WO2007/122724

PCT Pub. Date: Nov. 1, 2007

(65) Prior Publication Data

US 2009/0101661 A1 Apr. 23, 2009

(51) Int. Cl.
*B65D 1/42* (2006.01)

(52) U.S. Cl. ..... 220/658; 220/619

(58) Field of Classification Search ..... 220/619, 220/620, 669, 677–680, 658, 657, 656, 659
See application file for complete search history.

(56) References Cited

U.S. PATENT DOCUMENTS

| | | | | |
|---|---|---|---|---|
| 3,300,072 | A * | 1/1967 | Caviglia | 215/345 |
| 4,735,835 | A * | 4/1988 | Taira et al. | 220/678 |
| 5,181,615 | A * | 1/1993 | Thompson | 220/618 |
| 6,332,346 | B2 * | 12/2001 | Komiya et al. | 220/612 |
| 6,959,830 | B1 * | 11/2005 | Kanou et al. | 220/288 |
| 7,171,840 | B2 * | 2/2007 | Kanou et al. | 220/669 |
| 7,497,350 | B2 * | 3/2009 | Enoki et al. | 220/658 |
| 2005/0127077 | A1 * | 6/2005 | Chupak | 220/285 |

FOREIGN PATENT DOCUMENTS

| | | |
|---|---|---|
| JP | 57 163640 | 10/1982 |
| JP | 7 39649 | 2/1995 |
| JP | 2002 102967 | 4/2002 |
| JP | 3087983 | 8/2002 |
| JP | 2003 321039 | 11/2003 |
| JP | 2004 26306 | 1/2004 |

OTHER PUBLICATIONS

U.S. Appl. No. 12/297,247, filed Oct. 15, 2008, Masuda, et al.

* cited by examiner

*Primary Examiner* — Mickey Yu
*Assistant Examiner* — Chun Cheung
(74) *Attorney, Agent, or Firm* — Oblon, Spivak, McClelland, Maier & Neustadt, L.L.P.

(57) ABSTRACT

To ensure sealing ability of a resealable can container formed of a welded can body between a curled portion of container mouth and a resin sealing liner, without degrading productivity and easiness to open the closure.
The can body 2 is prepared by rolling a steel sheet and welding overlapped longitudinal edges of the steel sheet. In order to achieve the above-mentioned objective, a level difference of a welded portion 2*a* on the surface of a curled portion 21*a* is reduced smaller than that on the trunk portion 22, specifically, kept within the range of 15 to 100 μm, and a durometer hardness of the resin sealing liner is kept within the range of HDA 30 to 70 according to ISO 868 (or JIS-K7215).

2 Claims, 4 Drawing Sheets

CAN CONTAINER

TECHNICAL FIELD

This invention relates to a can container in which a can body is a welded can trunk, more specifically, to a resealable can container, comprising: a welded can body including a trunk portion and a container mouth; a curled portion formed on an opening end of the container mouth; a bottom lid seamed to a lower end of the trunk portion; and a detachable closure having a resin sealing liner, which is applied to the container mouth.

BACKGROUND ART

A bottle type and a wide-open type resealable metal can container, in which a container mouth and a can trunk are integrally shaped from a metal sheet and a bottom lid is seamed to an bottom end, and a bottle type and a wide-open type resealable metal can container, in which a can trunk and a bottom portion are integrally formed from a metal sheet and a container mouth is formed by drawing an opening end of the can trunk, are widely known in the prior art.

As disclosed in Japanese Patent Laid-Opens No. 2003-321039 and No. 2004-26306, the above-mentioned bottle type and a wide-open type resealable can container comprises an outwardly curled portion on an open end of the container mouth. In addition, a resin sealing liner to be contacted with the curled portion is affixed to an inner face of a closure thereof.

It has been considered to use a welded can body formed by rolling a metal sheet into cylinder and welding overlapped longitudinal edges of the metal sheet for manufacturing a resealable can container to be closed by a closure, instead of the above-mentioned seamless can in which a container mouth and a trunk portion are formed integrally from a metal sheet. In order to use the welded can body for manufacturing a resealable can container, it has been considered to form a container mouth to which a closure is applied on one of open ends of the welded can body.

However, the welded can body is prepared by overlapping longitudinal edges of the metal sheet and welding the overlapped edges as explained above. As a result, a level difference is inevitably formed at the welded portion even if the manufactured can is a small can made of a thin metal sheet. Here, it is quite difficult to completely eliminate the level difference resulting from welding the overlapped metal sheet. This means that such level difference appears inevitably on a surface of a curled portion formed on an open end of the container mouth of the welded can body.

When a closure is applied to the container mouth, a clearance has to be created between the surface of the curled portion and a resin sealing liner by the level difference of the welded portion on the curled portion being contacted with the liner. As a result, sealing ability may be degraded.

DISCLOSURE OF THE INVENTION

The present invention has been conceived noting the technical background as thus far described, and its object is to ensure a sufficient sealing ability between a curled portion of the container mouth and a resin sealing liner of a closure in a resealable can container in which a main body of the can is a welded can body, without degrading productivity and easiness to open the closure.

In order to achieve the above-mentioned object, according to the invention, there is provided a can container, comprising: a main body including a container mouth and a trunk portion formed of a cylindrical welded can body prepared by rolling a metal sheet and welding an overlapped longitudinal edges of the metal sheet; a curled portion formed on an open end of the container mouth; a bottom lid seamed to a lower end of the can body; and a closure having a resin sealing liner applied to the container mouth; characterized in that: a level difference of the welded portion on a surface of the curled portion contacted with the resin liner is smaller than a level difference of the welded portion on the trunk portion; the level difference of the welded portion on the surface of the curled portion is kept in the range of 15 to 100 μm; and a durometer hardness of the resin sealing liner is within the range of HDA 30 to 70 according to ISO 868 (equivalent to JIS-K7215).

In addition to above, at least the welded portion on inner face of the welded can body can be covered with a resin tape the thickness thereof is within the range of 10 to 50 μm.

According to the can container of the present invention as thus far explained, the level difference on the surface of the curled portion is minimized within the predetermined range. Moreover, the resin liner is comparatively a soft, in other words, a softness of the resin liner is kept within a predetermined range. Therefore, a contact face of the resin liner can be contacted tightly with the surface of the curled portion even to a corner of the welded portion. For this reason, a sufficient sealing ability can be ensured between the curled portion and the resin liner.

Specifically, the sealing ability can be enhanced by reducing the level difference of the welded portion on the surface of the curled portion, in other words, by reducing a height of a step at the end portion of the welded portion. However, an extraordinary forming process is required to reduce the level difference of the welded portion smaller than 15 μm. Consequently, the productivity is degraded. To the contrary, if the level difference of the welded portion is larger than 100 μm, the clearance between the curled portion and the resin sealing is enlarged and the sealing ability is thereby degraded. That is, both productivity and sealing ability can be ensured by keeping the level difference of the welded portion on the curled portion within the range of 15 to 100 μm.

In addition, if the durometer hardness of the resin sealing liner is larger than HDA 70, the liner cannot contact tightly with the surface of the curled portion even to the corner of the welded portion and the sealing ability is thereby deteriorated. To the contrary, if the durometer hardness of the resin sealing liner is smaller than HDA 30, the liner contacts to the surface of the curled portion too tight and an easiness to open the closure is thereby deteriorated. That is, both easiness to open the closure and sealing ability thereof can be ensured by keeping the durometer hardness of the resin sealing liner within the range of HDA 30 to 70.

BRIEF DESCRIPTION OF THE DRAWINGS

FIG. 2 (B) is a side view showing a can body before a bottom lid is seamed thereto.

DETAILED DESCRIPTION OF THE PREFERRED EMBODIMENT

Figure 1:
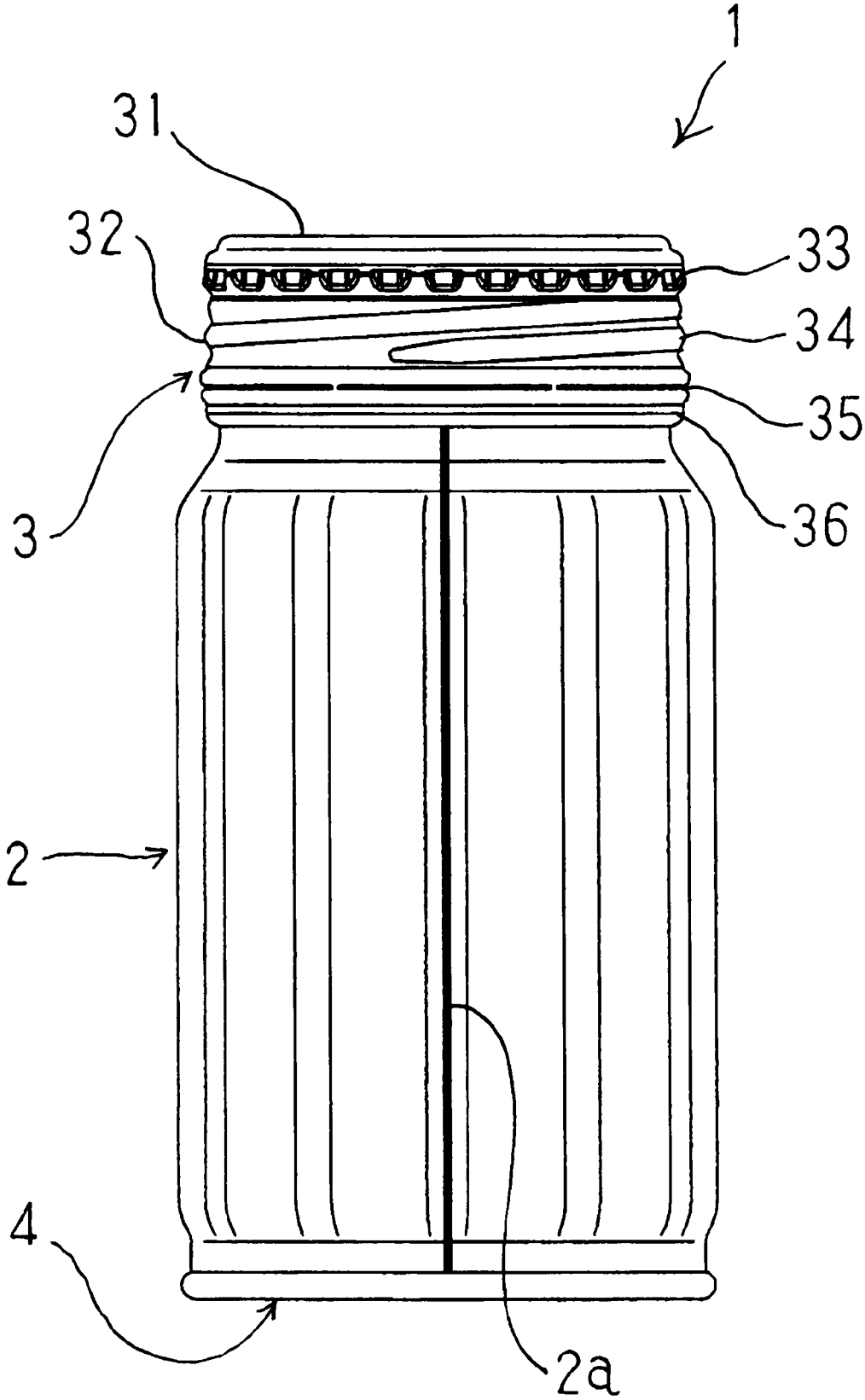
FIG. 1 is a side view showing one example of wide-open type resealable can of the invention.
Figure 2:
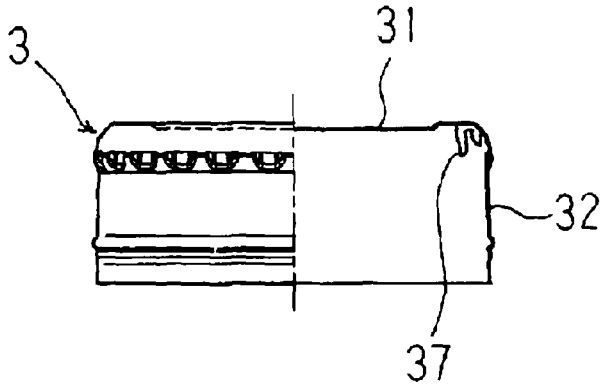
FIG. 2 (A) is a sectional view partially showing an unthreaded closure before mounted on the container mouth.
Figure 2:
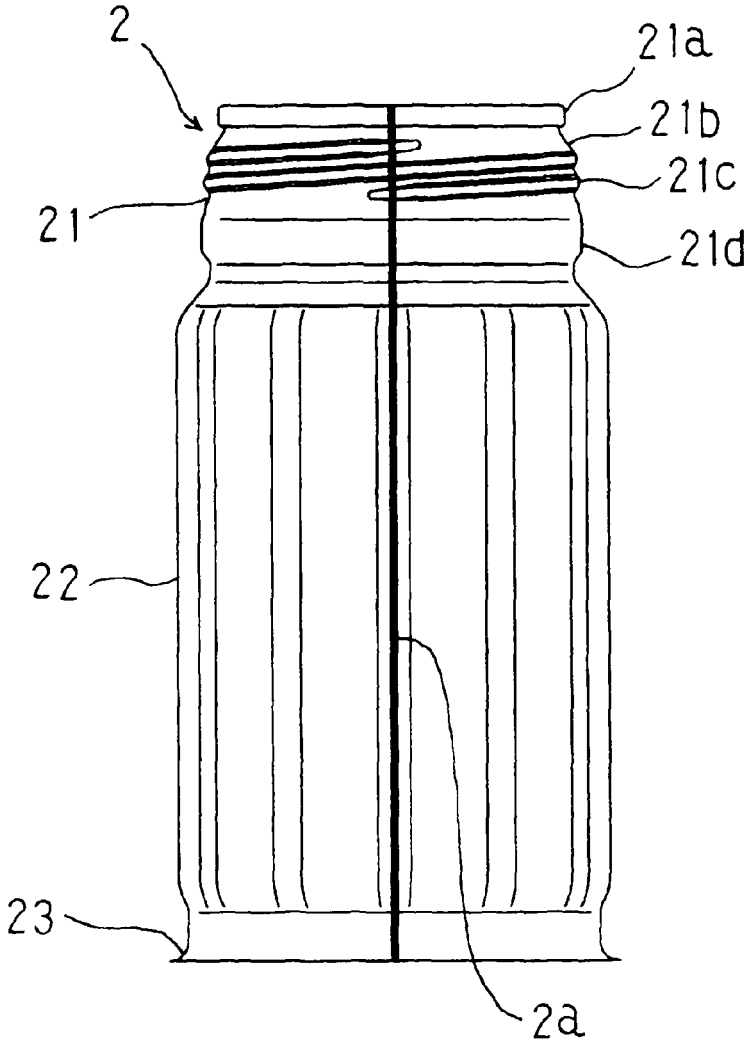

Here will be explained a preferable embodiment of the can container according to the invention shown in FIG. 1. FIG. 1 shows a wide-open type resealable can. A can body 2 of a can container 1 is a welded can body formed integrally by rolling a metal sheet into cylinder and welding overlapped longitudinal edges of the sheet. A container mouth 21 to which a metal closure 3 is applied by an engagement of thread is formed on one of the end portions of the welded can body. On the other hand, a bottom lid 4 is attached to other end of the welded can body by a double-seaming method. FIG. 2 (B) shows a can body 2 before the bottom lid 4 is seamed thereto. At this stage, the container mouth 21 has been formed on one of the end portions of the welded can body comprising a welded portion 2*a*, and a flange portion 23 to which the bottom lid 4 is to be seamed has been formed on the other end of can trunk. Here, an intermediate portion between the container mouth 21 and the flange portion 23 is a trunk portion 22. Additionally, according to the can container 1 of this embodiment, a plurality of longitudinal embosses is formed side-by-side on the trunk portion 22, by inserting a segment die into the welded can body and expanding the inserted segment die.

An outwardly curled portion 21*a* is formed on an upper open end of the container mouth 21, and a tapered portion 21*b* in which a diameter of the container mouth is gradually reduced upwardly is formed underneath the curled portion 21*a*. A thread 21*c* is formed on a peripheral wall of the container mouth 21 below the tapered portion 21*b*, and an annular bead 21*d* for preventing a pilfer-proof band of the closure from moving upward is formed below the thread 21*c*.

Here will be explained a closure 3 to be applied to the container mouth 21 of the can body 2. First of all, a cap shell shown in FIG. 2 (A) is formed from a known metal sheet material of an aluminum alloy or the like. The cap shell is then mounted on the container mouth 21 and a thread is rolled by a known capping apparatus (or capper). That is, the closure 3 is applied to the container mouth 21 in a resealable manner. Specifically, as shown in FIG. 1, the closure 3 comprises a skirt portion 32 extending downwardly from an outer circumference of a top panel 31. For the purpose of gas ventilation of carbonated beverage, vent slits 33 are formed on an upper portion of the skirt portion 32, and a thread portion 34 is formed below the vent slits 32. A portion below the thread portion 34 is sheared intermittently in the circumferential direction to form a weakened portion 35 comprising slits and bridges alternately. The bridges of the weakened portion 35 are ruptured when the closure 3 is opened, and a pilfer-proof ring 36 formed at the lowest portion of the skirt portion 32 is thereby detached.

Figure 3:
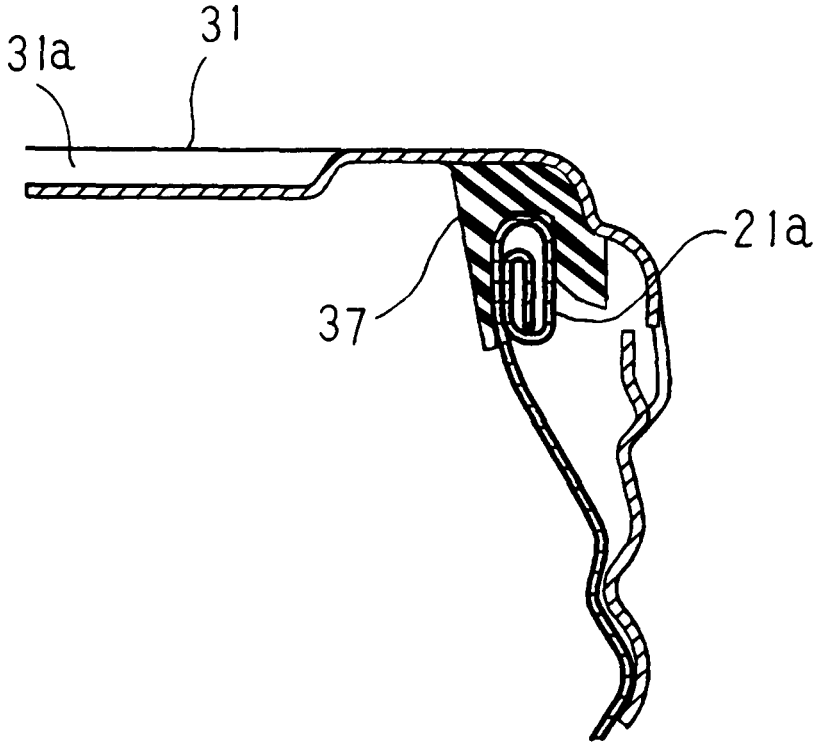
FIG. 3 is a longitudinal sectional view showing a resin liner of the closure shown in FIG. 2 (A) applied to the can body.

As shown in FIG. 2 (A), an injection molded annular resin sealing liner 37 is affixed to an inner face of the top panel 31 to be engaged with the curled portion 21*a* of the container mouth 21. Here, as shown in FIG. 3 or 4, a center portion of the top panel 31 inside of the resin sealing liner 37 is recessed to form a recessed portion 31 for enhancing strength of the top panel 31 against an inner pressure of the can container, and for preventing an outer face of the top panel 31 from being damaged by contact with foreign objects.

Figure 4:
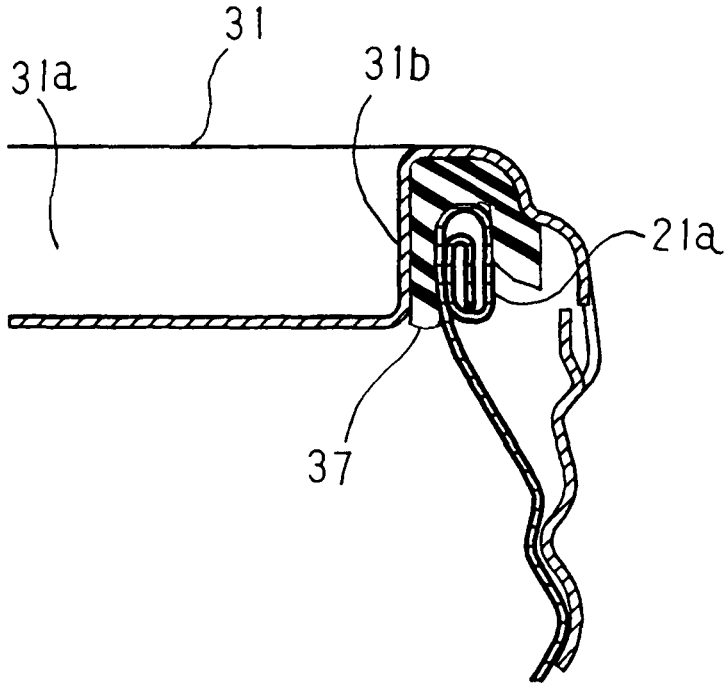
FIG. 4 is an enlarged longitudinal sectional view showing the resin liner of the closure of another example in which a top panel thereof is different from that of the closure shown in FIG. 3.

A sealing ability between the resin liner 37 and the curled portion 21*a* can be further enhanced by pressing an inner face of the resin liner 37 against the curled portion 21*a* by a side wall 31*b* of the recessed portion 31*a* of the top panel 31, as shown in FIG. 4.

A welded can body 2 is made of a known metal sheet material for cans such as a surface treated steel sheet. Specifically, both faces of the steel sheet are covered with a resin film of polyester series such as a polyethylene terephthalate resin except for a portion to be welded and vicinity thereof, and a decorative pattern is printed on the film covering a face to be an outer face of the can body. Then, the steel sheet is cut into a rectangular blank of a size of the can body. The rectangular blank is then rolled to expose the printed decoration on the outer face of the can body, and overlapped longitudinal edges of the steel sheet are welded by a conventional electric resistance seam welding.

As explained above, the resin film 10 of polyester series is not laminated on the portion to be welded and vicinity thereof. Therefore, the welded portion 2*a* and vicinity thereof has to be covered with a coating 11 of liquid coating compound or synthetic resin powder, or a resin tape 12 of polyester series such as a polyethylene terephthalate resin. In this case, at least the welded portion 2*a* of the inner face of the cylindrical welded can body and vicinity of the welded portion 2*a* is preferably covered with the resin tape 12.

Because the inner face of the can is to be contacted directly with the content, sufficient corrosion resistance of the inner face is required. For this reason, the welded portion 2*a* of the inner face and vicinity thereof has to be covered thickly also. However, if the coating compound is applied overly to enhance corrosion resistance of the inner face, the coating may be cracked or detached during a forming process of container mouth (including forming processes of curled portion and thread portion) on the cylindrical can body. Therefore, it is preferable to cover the welded portion 2*a* of the inner face with the resin tape, and the protective coating can endure such forming process of the container mouth by thus using the resin tape. Consequently, sufficient corrosion resistance and preferable quality of the inner face can be ensured.

In this embodiment, the resin tape 12 of polyethylene terephthalate resin is used to cover the welded portion 2*a* and the vicinity thereof. However, the resin tape 12 preferably consists of at least two layers having different fusing points. Specifically, the resin tape 12 preferably consist of an upper layer of higher fusing point, and a lower layer of lower fusing point which is to be contacted with the welded portion 2*a*. If the thickness of the resin tape 12 is thinner than 10 μm, the corrosion resistance thereof may be degraded. To the contrary, if the thickness of the resin tape 12 is thicker than 50 μm, the workability thereof is degraded. Therefore, the thickness of the resin tape 12 is kept within the range of 10 to 50 μm.

Although not especially shown in the accompanying figures, in order to form the container mouth 21 on the can body 2, one of the end portions of the welded can body is drawn into a diametrically small cylindrical container mouth. Then, the thread portion and a lower bead portion are formed on the peripheral wall of the cylindrical container mouth. The portion above the thread portion is further drawn to form a tapered portion in which a diameter thereof is gradually reduced upwardly, and to form a portion to be curled extending from an upper end of the tapered portion. Thereafter, the portion extending from the upper end of the tapered portion is curled outwardly and downwardly to form a curled portion.

The curled portion 21*a* of this embodiment is formed by folding the portion to be curled into four layers. Specifically, the upper end of the portion to be curled is bent outwardly to form a flange first of all, and then the flanged portion is folded downwardly. The resultant portion folded into two layers is bent outwardly again and then folded downwardly. The resultant portion folded into three layers is bent outwardly again and then folded downwardly. As a result, the curled portion 21*a* consisting of four layers is formed on the upper end of the container mouth.

According to this embodiment, the level difference of the welded portion 2*a* on the surface of the curled portion 21*a* (i.e., the level difference of the upper end of the welded portion 2*a* of the inner face of the can body) is smaller than the level difference of the welded portion 2*a* on the can trunk 22, and the level difference of the welded portion 2*a* on the surface of the curled portion 21*a* is kept within the range of 15 to 100 μm, more preferably, within the range of 15 to 500 μm. The details are to be explained later.

Figure 5:
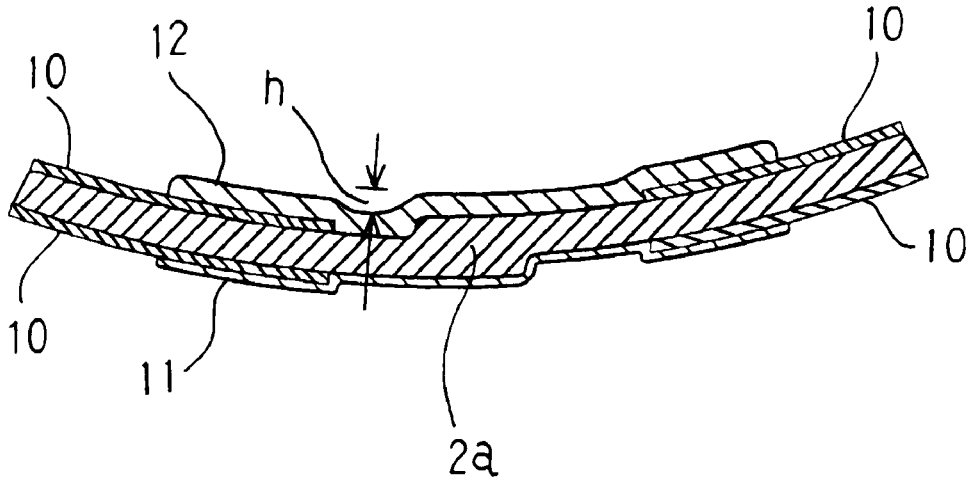
FIG. 5 is a sectional view showing a protective coating covering a welded portion of the can trunk and vicinity thereof.
Figure 6:
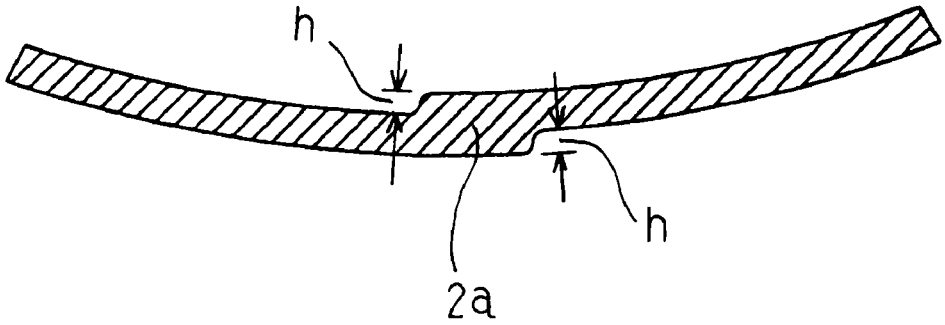
FIG. 6 is a sectional view showing the welded portion in which longitudinal edges of the metal sheet are overlapped.

Basically, a thickness of a blank of the metal sheet material to be used for manufacturing the welded can body is 0.17 to 0.23 mm. As shown in FIG. 6, a level difference h is created at both end portions of the overlapped metal sheet as a result of welding the metal sheet to form the welded portion 2*a*. For example, in case a thickness of the metal sheet is 0.19 mm, the level difference h of the welded portion 2*a* is 60 μm. As shown in FIG. 5, the level difference h remains even after covering the welded portion 2*a* of the can trunk with the resin tape 12.

According to this embodiment, the level difference h of the welded portion 2*a* is kept within the range of 15 to 100 μm. Specifically, on the trunk portion 22 of the can body 2 formed from a cylindrical welded can body, the level difference h of the welded portion 2*a* is 60 μm. On the other hand, the level difference h of the welded portion 2*a* on the curled portion 21*a* is 40 μm. As explained above, the inner face of the can trunk is exposed as the outer face at the curled portion 21*a*.

In order to keep the level difference h within the range of 15 to 100 μm on the curled portion, the level difference h on the curled portion is reduced by reducing a diameter of the end portion of the welded can body to be the container mouth 15 to 25% in comparison with an original diameter of the cylindrical welded can body. In this case, if the reducing rate of the diameter is smaller than 15%, plastic effect to reduce the level difference h of the welded portion 2*a* is insufficient. To the contrary, if the reducing rate of the diameter is larger than 25%, the portion where the diameter thereof is reduced may be wrinkled thereby deteriorating the quality of the can.

A synthetic resin of e.g., olefin series, polyester series, styrene series, acrylic series, or the like can be used as a material of the resin sealing liner 37 to be affixed to the inner face of the top panel 31 of the closure 3. More specifically, polypropylene resin containing styrene elastomer, polyester series elastomer or the like can be used as a material appropriate for the resin sealing liner 37. A heat-resistant stabilizer, a weathering stabilizer, an anti-blocking agent, an antistatic, a surfactant, a plasticizer, a lubricant, a pigment and so on are added to the above-mentioned thermoplastic resin. According to this embodiment, a durometer hardness of the resin sealing liner 37 is kept within the range of HDA 30 to 70 according to ISO 868 (or JIS-K7215).

Thus, according to the can container 1 of the embodiment, the level difference h of the welded portion 2*a* is kept within the range of 15 to 100 μm on the surface of the curled portion 21*a* to which the resin sealing liner 37 is contacted, and the durometer hardness of the resin sealing liner 37 is within the range of HDA 30 to 70 according to ISO 868. Therefore, a sealing ability between the curled portion 21 and the resin sealing liner 37 can be ensured sufficiently without degrading productivity of producing the can body 2 from the cylindrical welded can body, and without deteriorating easiness to open the closure 3 applied to the container mouth 21.

In addition to above, in case of using a metal sheet of 0.1 to 0.25 mm thickness to form a welded can body, the sealing ability can be enhanced by reducing the level difference h of the welded portion 2*a* to 15 to 50 μm on the surface of the curled portion 21 without degrading the productivity.

Although the sealing ability can be enhanced by reducing the level difference h of the welded portion 2*a* on the surface of the curled portion 21, an excessive forming process is required when forming the can body 2 having the container mouth 21 from a cylindrical can trunk, so as to reduce the level difference h smaller than 15 μm. That is, the productivity has to be degraded instead of reducing the level difference h smaller than 15 μm on the surface of the curled portion 21. To the contrary, if the level difference h is larger than 100 μm on the surface of the curled portion 21*a*, a clearance between the surface of the curled portion 21*a* and the sealing face of the resin liner 37 is too big to ensure the sealing ability therebetween.

If the durometer hardness of the resin sealing liner 37 is larger than HDA70 according to ISO 868 (or JIS-K7215), the sealing face of the resin liner 37 cannot be fit to the corner of the welded portion 2*a* on the surface of the curled portion 21*a* and the sealing ability is thereby degraded. To the contrary, if the durometer hardness of the resin sealing liner 37 is smaller than HDA30 according to ISO 868 (or JIS-K7215), the sealing face of the resin liner 37 is contacted to the surface of the curled portion 21*a* too tight. Consequently, the easiness to open the closure 3 is deteriorated.

The present invention should not be limited to the specific embodiment thus far explained. For example, the closure having the resin sealing liner is not limited to a closure made of a metal shell but a closure made of resin can also be used in the invention. That is, design of the closure can be changed depending on the situation.

The invention claimed is:

1. A resealable can container, comprising:

a main body having a container mouth and a trunk portion formed of a cylindrical welded can body prepared by rolling a metal sheet and welding an overlapped longitudinal edges of the metal sheet at a welded portion, wherein a level difference of the welded portion exists at the overlapped longitudinal edges of the metal sheet;

a curled portion formed on an open end of the container mouth, wherein the metal sheet of the main body is curled outwardly to expose an inner face of the metal sheet as an outer face of the curled portion;

a bottom lid seamed to a lower end of the can body; and a closure having a resin sealing liner applied to the exposed inner face at the curled portion formed on an open end of the container mouth;

wherein the level difference of the welded portion on the exposed inner face at the curled portion contacted with the resin sealing liner is smaller than the level difference of the welded portion on the trunk portion;

the level difference of the welded portion on the exposed inner face at the curled portion is within the range of 15 to 100 μm;

a durometer hardness of the resin sealing liner is within the range of HDA 30 to 70 according to ISO 868;

the diameter of the main body at the curled portion is 15% to 25% smaller than the diameter of the main body at the trunk portion; and the level difference of the welded portion on a surface of the curled portion is made to be within the range of 15 to 100 μm.

2. The can container as set forth in claim 1, wherein:

at least the welded portion on an inner face of the welded can body is covered with a resin tape the thickness thereof is within the range of 10 to 50 μm.

* * * * *